US005667002A

United States Patent [19]

Neustadt

[11] Patent Number: 5,667,002

[45] Date of Patent: Sep. 16, 1997

[54] SINGLE-POINT TENSIONING DOOR SYSTEM FOR CONTAINERS

[75] Inventor: Ariel Neustadt, Torrance, Calif.

[73] Assignee: Air Cargo Equipment Corporation, Rancho Dominguez, Calif.

[21] Appl. No.: 731,714

[22] Filed: Oct. 17, 1996

[51] Int. Cl.[6] ..... A47H 13/00

[52] U.S. Cl. ..... 160/368.1; 220/1.5

[58] Field of Search ..... 160/368.1, 327, 160/328, 354; 220/1.5, 200, 284, 263, 264, 324, 326, 315

[56] References Cited

U.S. PATENT DOCUMENTS

| | | | |
|---|---|---|---|
| 4,046,186 | 9/1977 | Nordstrom . | |
| 4,429,730 | 2/1984 | Elston . | |
| 4,538,663 | 9/1985 | Looker | 160/368.1 |
| 4,601,405 | 7/1986 | Riemer | 160/368.1 |
| 5,242,070 | 9/1993 | Bretschneider et al. | 220/326 X |
| 5,395,682 | 3/1995 | Holland et al. | 220/1.5 X |
| 5,570,801 | 11/1996 | Younger | 220/1.5 |

FOREIGN PATENT DOCUMENTS 2 091 695 8/1982 United Kingdom .

*Primary Examiner*—David M. Purol
*Attorney, Agent, or Firm*—Pretty, Schroeder & Poplawski

[57] ABSTRACT

A door for a container having a door frame with top, sides and bottom, the door having a flexible door panel with a top, sides and a bottom, with an arrangement for attaching the door panel top to the door frame top. Pulleys are attached to the door frame at the four corners of the frame. Three cables are carried by the door panel, with one cable anchored to the door frame at the lower right corner and running over the upper right pulley to a upper cable junction ring, a second cable anchored to the door frame at the lower left corner and running over the upper left pulley to the upper cable junction ring, a third cable having both ends joined to a lower cable junction ring and running over the lower right pulley and the lower left pulley, and a buckle having upper and lower ends connected to the upper and lower cable junction rings, respectively, and including a strap for tensioning the cables by drawing the upper and lower cable junction rings toward each other.

5 Claims, 3 Drawing Sheets

SINGLE-POINT TENSIONING DOOR SYSTEM FOR CONTAINERS

BACKGROUND OF THE INVENTION

This invention relates to doors for containers, such as the cargo containers used with large aircraft. Two types of doors are presently in use, a solid door and a flexible door. Solid doors have been in use for some time, but have the disadvantage of a significantly greater weight and cost than the flexible doors. The flexible door is made of some type of sheet or woven fabric, and prior art designs for flexible doors are shown in U.S. Pat. Nos. 4,046,186 and 4,429,730. In the container cover of the U.S. Pat. No. 4,046,186, two reinforcing cables are diagonally fitted in the cover or door, and another peripheral cable fits into flanges in the door frame, with this cable being pulled tight by a ratchet to hold the door in place. However, the tensioning provided is not equal in both diagonal cables nor equal in the diagonal and peripheral cables. In the door or cover of the U.S. Pat. No. 4,429,730, cables in the door are pulled taut by a toggle type mechanism at each of the two lower corners. This design does not provide for any additional tensioning of the diagonally positioned cables after the door is in place in the door frame.

In another prior art design four cables or straps are positioned about the sides and bottom of the door and diagonally across the door, in two sets of two, with each set tensioned by a buckle, thereby requiring two buckles and two tensioning actions.

These prior art designs have various disadvantages. Those which provide no secondary tensioning of the cables positioned across the door opening are undesirable in that there is no way to pull the door flat after closure. This can be a particular problem when items loaded within the container shift during handling, often resulting in cargo falling outward when the door is opened with resultant damage to the cargo and/or to the cargo handler.

A disadvantage of the design with the two sets of cables and two buckles is that the cargo handler must separately tension each of the sets of cables after the door is closed, requiring additional effort and providing an opportunity for failure of the cargo handler to adequately tension both buckles.

Other disadvantages include the fact that load shifting during usage places stress on the cover making it difficult to release. Also, some designs with flexible doors require a heavy bottom horizontal member which sometimes causes damage to the container, the aircraft, and/or the personnel handling the container. By way of example, after a flexible door is released, the lower portion of the door is flipped upward to rest on the top of the container during unloading and loading. The damage may occur when the door bottom is not properly handled during this motion or when the door slides off of the top of the container.

It is an object of the present invention to provide a new and improved flexible door for a cargo container and the like which does not have the disadvantages discussed above. Another object of the invention is to provide such a door which requires only three cables and only one adjustable buckle.

It is a further object of the invention to provide such a flexible door which can be closed with a minimum of effort and which can then be tensioned both peripherally and diagonally by actuation of a single buckle mechanism, which buckle does not need to be disconnected and reconnected during use.

Other objects, advantages, features and results will more fully appear in the course of the following description.

SUMMARY OF THE INVENTION

A door for a container having a door frame with top, sides and bottom, and including a flexible door panel having a top, sides and a bottom, attachment means for attaching the door panel top to the door frame top, an upper right pulley and means for attaching the upper right pulley to the door frame at the upper right corner, an upper left pulley and means for attaching the upper left pulley to the door frame at the upper left corner, a lower left pulley and means for attaching the lower left pulley to the door frame at the lower left corner, a lower right pulley and means for attaching the lower right pulley to the door frame at the lower right corner, upper and lower cable junction means for joining cables together, a first cable carried by the door panel, with first means for anchoring one end of the first cable to the door frame at the lower right corner and with the first cable running over the upper right pulley to the upper cable junction means, a second cable carried by the door panel, with second means for anchoring one end of the second cable to the door frame at the lower left corner and with the second cable running over the upper left pulley to the upper cable junction means, a third cable having both ends joined to the lower cable junction means and running over the lower right pulley and the lower left pulley, and a buckle having upper and lower ends connected to the upper and lower cable junction means, respectively, the buckle including means for tensioning the first, second and third cables by drawing the upper and lower cable junction means toward each other.

In the preferred embodiment the flexible door panel includes cable guides for positioning the first cable along one of the door sides, and positioning the second cable along the other of the door sides, and positioning the third cable along the door bottom. The preferred embodiment also includes a plate having the first cable and the lower right pulley attached thereto, and an opening for receiving a stud of the door frame, and another similar plate for the second cable and lower left pulley. The plates include hand grips for pulling the plates outward to engage the door frame studs.

DESCRIPTION OF THE PREFERRED EMBODIMENT

Figure 1:
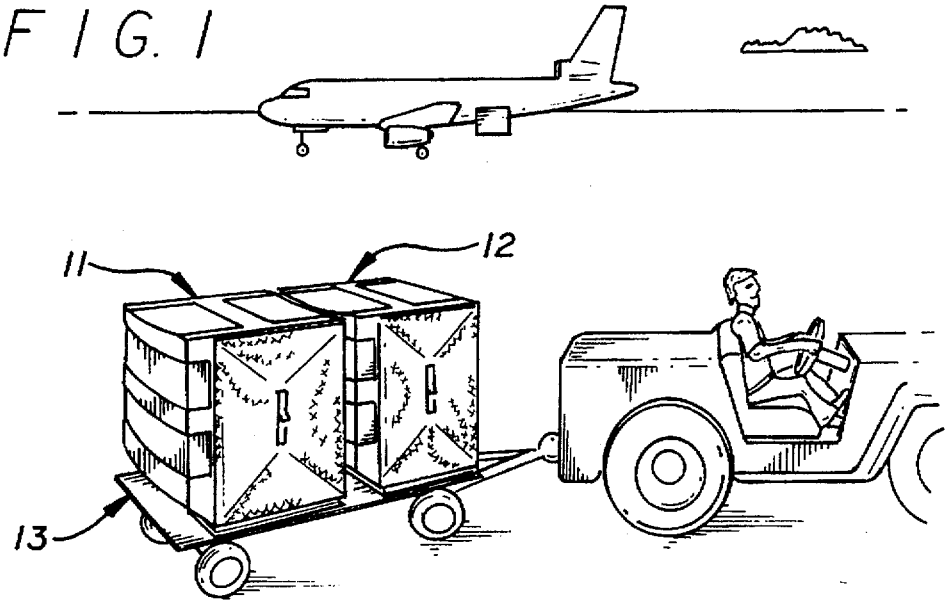
FIG. 1 is a view showing two cargo containers incorporating the presently preferred embodiment of the invention, being transported on a trailer for loading onto an aircraft.

In FIG. 1 two identical containers 11, 12 are being transported on a trailer 13 for loading onto an aircraft. The containers are conventional in construction and have a door frame with a top 14, sides 15, 16 and bottom 17. A door or cover 20 is attached at the top of the door to the top of the container. The door includes a panel of a flexible material which may be a sheet or a woven material and typically is a woven nylon.

Figure 3:
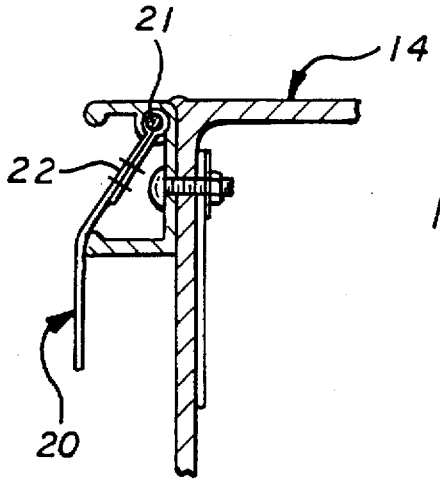
FIG. 3 is an enlarged sectional view taken along the line 3—3 of FIG. 2.

In the embodiment illustrated, a rod or a cable 21 is positioned in a pocket 22 formed at the top of the door. A door frame bracket 23 is attached to the top 14 of the door frame and has a horizontal groove for slidingly receiving the top of the door with the rod. This construction is shown in detail in FIG. 3 and is a conventional arrangement for attaching a flexible door to a door flame.

Figure 4:
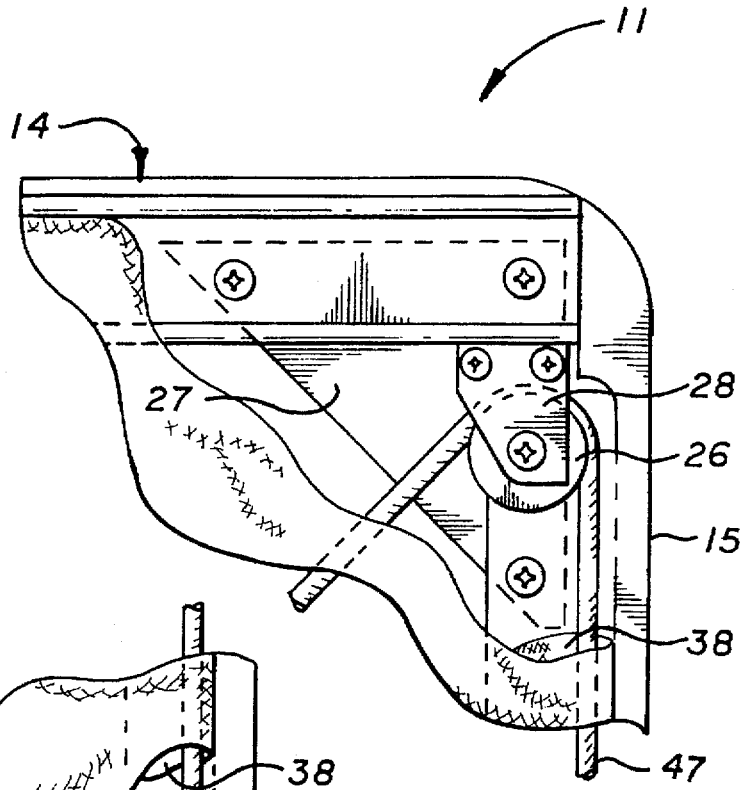
FIG. 4 is an enlarged partial view indicated by the circular line 4 of FIG. 2.
Figure 5:
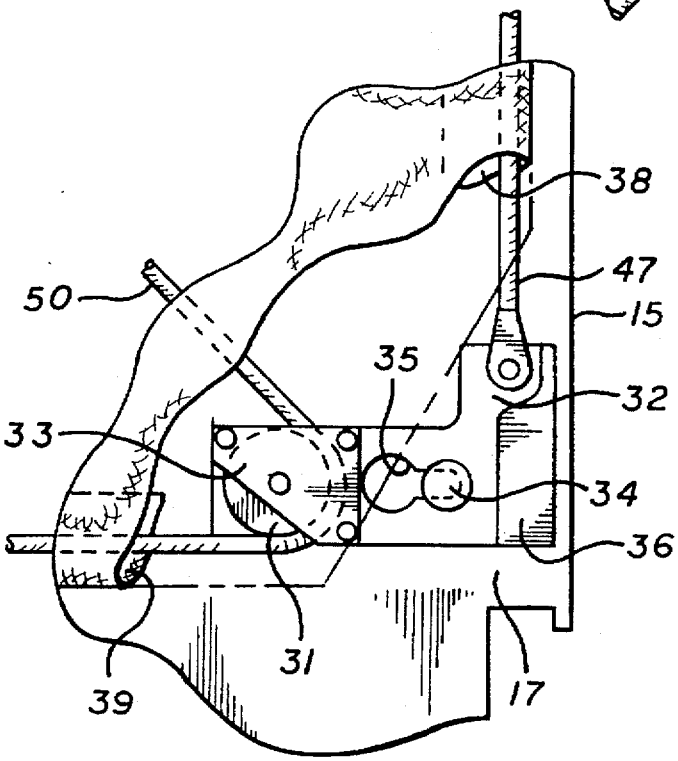
FIG. 5 is another enlarged partial view indicated by the circular line 5 of FIG. 2.
Figure 6:
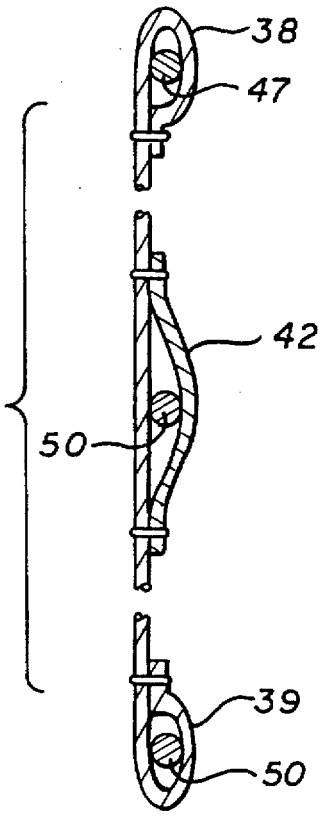
FIG. 6 is an enlarged partial sectional view taken along the line 6—6 of FIG. 2.
Figure 7:
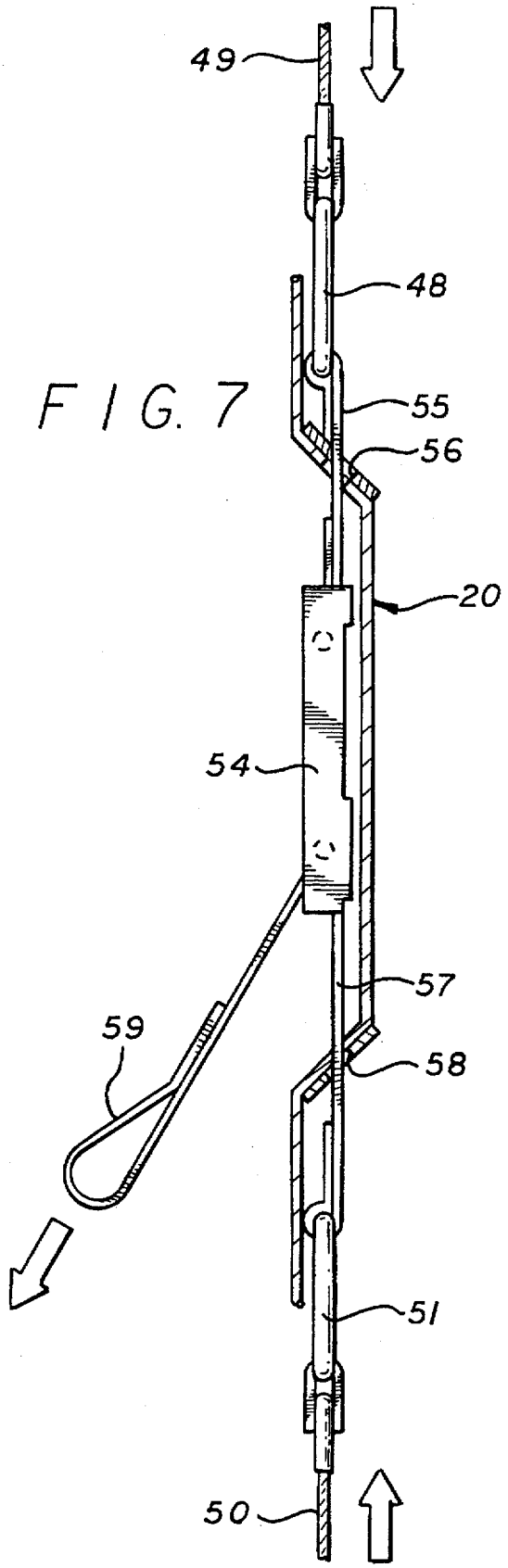
FIG. 7 is an enlarged partial sectional view taken along the line 7—7 of FIG. 2.

A pulley is mounted at each corner of the door frame, and the preferred construction for the upper right and upper left corners is shown in FIG. 4 and the preferred construction for the lower right and lower left corners is shown in FIG. 5. A pulley 26 is mounted at the upper right corner of the door frame between a gusset plate 27 and another plate 28. Another pulley 29 (not shown) is similarly mounted at the upper left corner of the door frame. A pulley 31 is mounted between a plate 32 and another plate 33 positioned at the lower right corner of the door panel. A stud 34 is positioned in the door frame and has an enlarged head projecting outward. A keyhole shaped opening 35 is provided in the plate 32 for receiving the stud 34. Preferably, the plate 32 has a U-shaped handle section 36 which permits pulling the door downward and to the right for passing the enlarged head oft he stud 34 through the enlarged section of the opening 35, after which the cables (in a manner to be described) pull the plate 32 to the left locating the stud in the opening in the position shown in FIG. 5. A similar construction for another pulley 37 (not shown) is provided at the lower left corner of the door panel.

Figure 2:
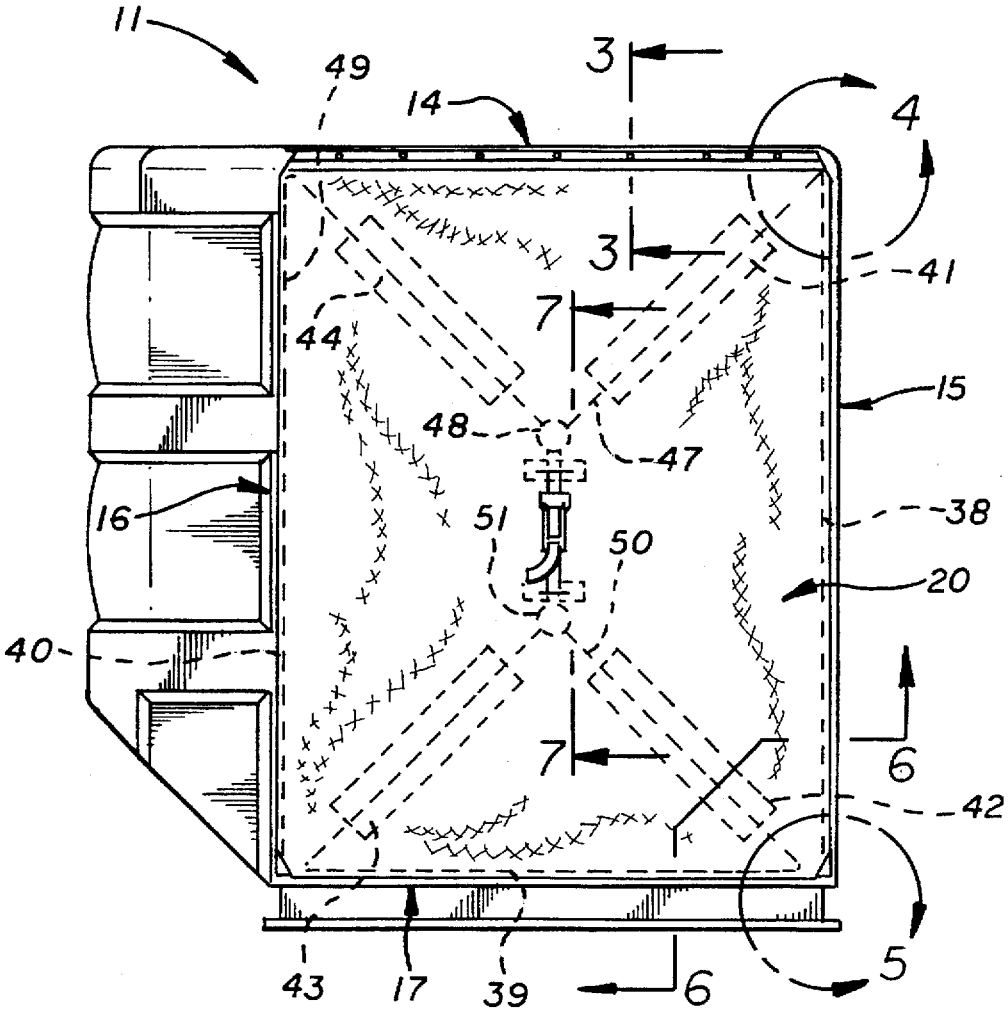
FIG. 2 is an enlarged side view of one of the containers of FIG. 1.

Pockets 38, 39 and 40 are provided at the right edge, bottom edge and left edge, respectively, of the door panel for receiving cables in a manner to be described. Also, diagonal pockets 41, 42, 43 and 44 may be provided on the inner face of the door as illustrated in FIG. 2.

A cable 47 is connected at one end to the plate 32, and runs upward through the fight pocket 38, over the pulley 26, through the pocket 41, and is connected at the other end to a ring 48 which serves as an upper cable junction. A similar cable 49 is connected at one end to the lower left plate, and runs upward through the left pocket 40, over the upper left pulley, and through the pocket 44 to the ring 48.

Another cable 50 is anchored at both ends to the lower ring 51 and runs over the lower right pulley 31 and the lower left pulley 37.

A buckle 54 is positioned on the outer surface of the door or cover 20, which an upper end 55 passing through an opening 56 in the cover and connected to the ring 48. Similarly, a lower end 57 of the buckle passes through an opening 58 of the cover and is connected to the ring 51. The buckle has a conventional pull strap 59 which may be pulled to tighten the buckle and tension the cables connected to the rings 48, 51. The tension produced by the buckle may be released in a conventional manner by dislocating the sprocket release lever of a ratching buckle and rotating the handle through 180°, by upwardly rotating the handle of an overcenter tensioning buckle until tension is released, or by depressing the strap grip cam handle of a cam action buckle.

In operation, the cargo handler will release the tension of the buckle, then pull on the lower end 57 of the buckle strap to slacken each of the three cables, and then release the two lower corner plates by pulling each outward to raise the plate over the stud. Then the cover is flipped up onto the top of the container and the container is unloaded.

The container next will be loaded in the customary manner and the door or cover will be pulled down over the door frame. Each lower corner plate is positioned on the study by pulling outward on the handle of the plate. The door is now in position on the door frame, with some tension in the cables. Finally, the strap 59 of the buckle is pulled downward, which draws the rings 48, 51 toward each other and produces a tension load in each of the three cables. This additional tension provides tension both around the periphery of the door and also diagonally across the door, with a single pulling motion. A load applied to a cable at any location increases the tension in all other cables and in so doing limits the deflection of the door.

While a steel wire cable is preferred, woven straps and other forms of strapping may be utilized, and the word cable as used herein, is intended to cover these various types of connecting materials.

I claim:

1. A door for a container having a door frame with top, sides and bottom, said door including in combination:

a flexible door panel having a top, sides and a bottom;

attachment means for attaching said door panel top to said door frame top;

an upper right pulley and means for attaching said upper right pulley to said door frame at the upper right corner;

an upper left pulley and means for attaching said upper left pulley to said door frame at the upper left corner;

a lower left pulley and means for attaching said lower left pulley to said door frame at the lower left corner;

a lower right pulley and means for attaching said lower right pulley to said door frame at the lower right corner;

upper and lower cable junction means for joining cables together;

a first cable carried by said door panel;

first means for anchoring one end of said first cable to said door frame at said lower right corner, with said first cable running over said upper right pulley to said upper cable junction means;

a second cable carried by said door panel;

second means for anchoring one end of said second cable to said door frame at said lower left corner, with said second cable running over said upper left pulley to said upper cable junction means;

a third cable having both ends joined to said lower cable junction means and running over said lower right pulley and said lower left pulley; and a buckle having upper and lower ends connected to said upper and lower cable junction means, respectively, said buckle including means for tensioning said first, second and third cables by drawing said upper and lower cable junction means toward each other.

2. A door as defined in claim 1 wherein said flexible door panel includes cable guide means for positioning said first cable along one of said door sides, and positioning said second cable along the other of said door sides, and positioning said third cable along said door bottom.

3. A door as defined in claim 2 wherein said means for attaching said lower right pulley to said door frame includes a plate having said first cable and said lower right pulley attached thereto, and an opening for receiving a stud of said door frame.

4. A door as defined in claim 3 wherein said stud has a shaft with an enlarged end and said plate opening has two components, one component of a size for passing said enlarged end and the other component of a smaller size for receiving said shaft and positioned toward said corner relative to said one component.

5. A door as defined in claim 4 wherein said plate includes a hand grip for pulling said plate toward said lower right corner.

* * * * *